US005409141A

United States Patent [19]

Kikuchi et al.

[11] Patent Number: 5,409,141

[45] Date of Patent: Apr. 25, 1995

[54] TWO COMPONENT MIXING AND DELIVERY SYSTEM

[75] Inventors: Toshihiro Kikuchi, Suita; Hitoshi Futagawa, Kusatsu; Koji Ikeda, Osaka, all of Japan

[73] Assignee: Nissho Corporation, Osaka, Japan

[21] Appl. No.: 26,404

[22] Filed: Mar. 4, 1993

[30] Foreign Application Priority Data

Mar. 13, 1992 [JP] Japan ..... 4-089712

[51] Int. Cl.[6] ..... B67D 5/06

[52] U.S. Cl. ..... 222/81; 222/83; 206/219; 206/221; 604/82

[58] Field of Search ..... 222/80, 83, 81, 145; 206/219, 221; 215/DIG. 8; 604/410, 411, 414, 82, 87, 88, 89

[56] References Cited

U.S. PATENT DOCUMENTS

| | | | |
|---|---|---|---|
| 2,362,025 | 11/1944 | Price | 604/88 |
| 3,207,374 | 9/1965 | Holmes et al. | 222/80 |
| 3,410,444 | 11/1968 | Morane | 206/221 |
| 3,482,258 | 2/1969 | Steen | 222/80 X |
| 3,917,063 | 11/1975 | Chibret et al. | 222/83 X |
| 4,583,971 | 4/1986 | Bocquet et al. | 604/82 |
| 4,735,608 | 4/1988 | Sardam | 604/82 X |
| 4,781,679 | 11/1988 | Larkin | 604/88 |
| 4,784,658 | 11/1988 | Grabenkort | 604/410 |
| 4,871,354 | 10/1989 | Conn et al. | 64/89 |
| 4,936,841 | 6/1990 | Aoki et al. | 604/82 X |
| 5,152,965 | 10/1992 | Fisk et al. | 604/82 X |
| 5,186,323 | 2/1993 | Pfleuger | 206/221 |
| 5,226,878 | 7/1993 | Yound | 604/82 X |

FOREIGN PATENT DOCUMENTS

| | | | |
|---|---|---|---|
| 0335378 | 10/1989 | European Pat. Off. . | |
| 0503867 | 9/1992 | European Pat. Off. . | |
| 516117 | 12/1992 | European Pat. Off. | 604/410 |
| 63-135642 | 9/1988 | Japan . | |
| 4294752 | 10/1992 | Japan | 222/81 |
| 8902730 | 4/1989 | WIPO | 206/219 |

*Primary Examiner*—Andres Kashnikow
*Assistant Examiner*—Kenneth Bomberg

[57] ABSTRACT

A drug delivery system including a drug container containing a dose of a dry drug and having a mouth portion sealed by a sealing member including a packing, a spherical closing member and a holding member; a solvent container containing a solvent and having at either ends first and second openings also sealed by a sealing member at least one sealing member for the first opening of the solvent container including a packing, a spherical closing member and a holding member; and a fluid-communication member arranged between the mouth portion of the drug container and the first opening of the solvent container.

5 Claims, 3 Drawing Sheets

TWO COMPONENT MIXING AND DELIVERY SYSTEM

BACKGROUND OF THE INVENTION

1. Field of the Invention

The present invention relates to a drug delivery system and, more particularly, a drug delivery system for separately holding a drug and a solvent in containers and aseptically mixing them to administrate the resultant solution to a patient.

2. Description of the Prior Art

In medical facilities such as hospitals, dry drugs such as powdered drugs, freeze-dried drugs or solid medicines held in drug containers or vials have been used for intravenous drip infusion by dissolving them in a diluent such as distilled water, a physiological saline, glucose solution, a drug solution or other solvent.

To facilitate dissolving operations, various drug delivery systems have been proposed of the kind wherein a drug container, such as a vial containing a dry drug, and a flexible container containing a diluent are connected to each other in series and adapted to be communicated with each other by piercing edges of a double pointed hollow needle into respective rubber plugs of the two containers to allow the diluent to flow into the drug container, for example, as in JP-T-S61-501129, JP-A-H2-1277 and JP-A-S63-135642.

JP-T-S61-501129, which corresponds to U.S. Pat. No. 4,583,971, to Bacquet et al. discloses a closed drug delivery system using a flexible container having a liquid diluent therein, a capsule coupled to the flexible container, a drug vial having a drug therein adapted to be mixed with the diluent, said drug vial being supported in the capsule by a supporting means of the capsule, and a coupling means for coupling the capsule to the interior of the flexible container. In this system, the drug vial is communicated with the flexible container by a communicating means arranged in the coupling means, thus making it possible to aseptically mix the drug with the solvent.

JP-A-H2-1277, which corresponds to U.S. Pat. No. 4,936,841 to Aoki et al., discloses a container having comprising a flexible container containing a diluent, a capsule having a cylindrical connecting portion at its one end and being connected to a mouth portion of the flexible container at the connecting portion, a drug container held in the capsule, and a communicating member arranged in the capsule for communicating the flexible container with the drug container. In use, the communicating member first pierces the plug in the drug vial and then pierces the flexible container to communicate the closing film of the flexible container with the drug container. Since the flexible container is communicated with the drug container in the closed system, it is possible to aseptically mix the drug with the solvent.

JP-A-S63-135642 (utility model) discloses a drug delivery system using a solvent container containing a diluent therein, a drug container or vial containing a dry drug and arranged in series with the flexible container, and a double pointed hollow needle slidably supported by a ring removably arranged in the drug container, the hollow needle being adapted so that one end pieces a rubber stopper of the drug container and at the other end of the needle pierces a rubber plug of the flexible container to aseptically connect two containers just before use.

All the above drug delivery systems of the prior art may be used with various vials on the market. However, conventional delivery systems utilize a piercing hollow needle to connect the drug container with the solvent container, so that as the rubber plugs are cored by the hollow needle, small rubber pieces result which are liable to cause mixing of the resulting drug solution with foreign substances. Further, the drug delivery system of JP-T-S61-501129 requires a several different parts that makes it necessary to manually break a frangible member arranged between the drug container and the diluent container, thus making it troublesome to handle. In addition, incomplete fracture of the fracturable member delays the flow of solvent, extending the time required for dissolution of the drug.

The drug delivery system of JP-A-H2-1277 is free from contamination by foreign substances and is much improved in operating simplicity, as compared with that of JP-T-S61-501129. However, it also requires a complex arrangement of several different parts for connecting the vial with the solvent container.

In contrast therewith, the drug delivery system of JP-A- S63-135642 (utility model) uses a small number of parts and is relatively simple in operation. However, it is necessary to apply a large external force to the vial to communicate the vial with the liquid container. Thus, it is troublesome to handle. Also, there is a fear of leakage of the drug solution when removing the double pointed needle from the plugs.

SUMMARY OF THE INVENTION

It is therefore an object of the present invention to provide a liquid medicine delivery system which enables a user to aseptically mix a drug with a solvent and which is free from contamination by foreign substances, simple to operate, free from leakage of a drug solution, and small in the number of parts.

The above and other objects of the present invention are achieved by providing a drug delivery system comprising:

- a drug container having a mouth portion sealed by a sealing means including a packing, a spherical closing member and a holding member;
- a solvent container having first and second openings at either ends and being sealed by a sealing means, the first opening being adapted to be used as a port for fluid-communication with the drug container, while the second opening being adapted to be used as a discharge port for a drug solution, at least one sealing means for the first opening of said container including a packing, a spherical closing member and a holding member; and
- a fluid-communication member for communicating said drug container with said solvent container, said fluid-communication member being arranged between said mouth portion of the drug container and said first opening of the solvent container and including a supporting portion and a tubular portion held at a longitudinal central portion thereof by said supporting portion.

BRIEF DESCRIPTION OF THE DRAWINGS

The above and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
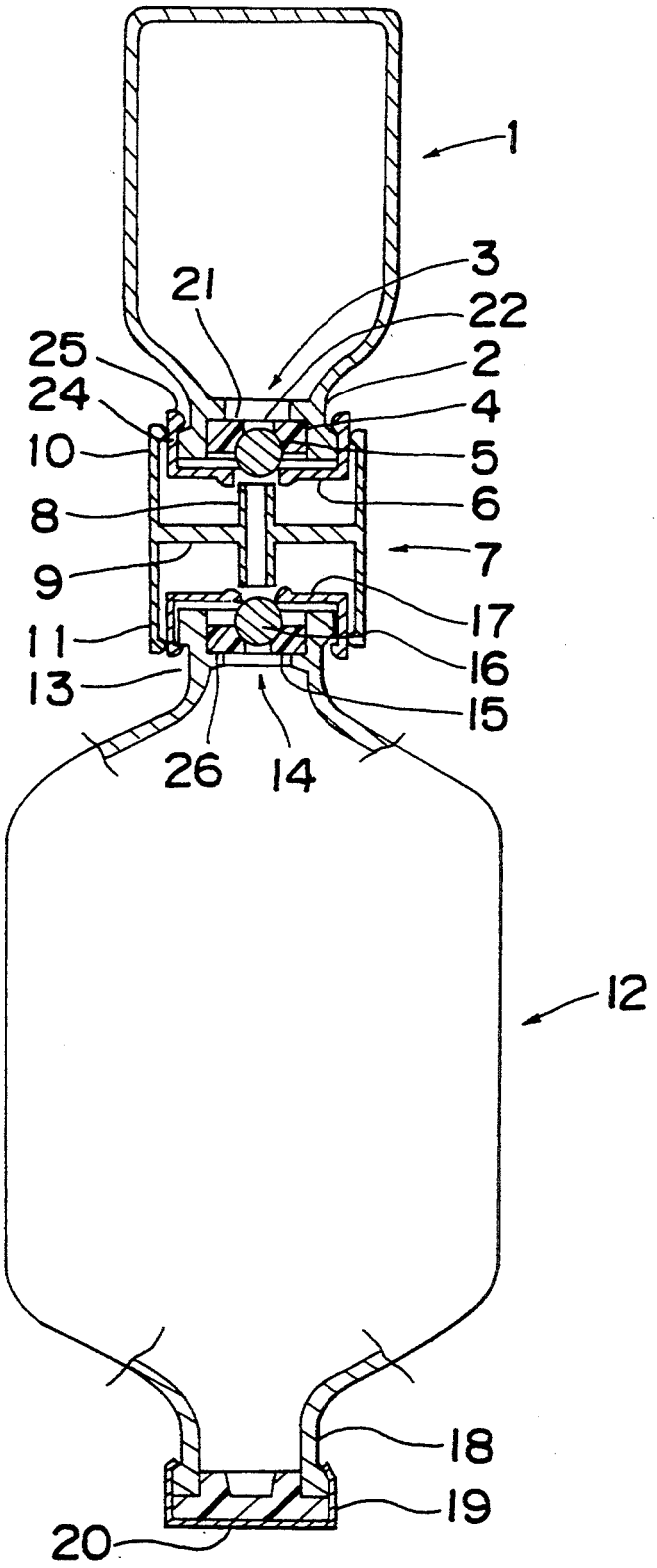
FIG. 1 is a partial sectional view of a drug delivery system illustrating a preferred embodiment of the present invention.

Referring to FIG. 1, there is shown a drug delivery system according to the present invention. The system generally includes a drug container 1 containing a dose of a dry drug and having at one end a mouth portion 2 sealed by a sealing member 3 which includes a packing 4, a spherical closing member 5 and a holding member 6. A solvent container 12 holds a dose of a solvent and has at either ends first and second mouth portions 13 and 18 each being sealed by a sealing member 14 for the first mouth portion and a second sealing member 19 for the second mouth portion, (the sealing member for the first mouth portion 13 of the solvent container including a packing 15, a spherical closing member 16 and a holding member 17); and a fluid-communication member 7 arranged between the mouth portion 2 of the drug container 1 and the first opening 13 of the solvent container 12 for forming fluid-communication between the drug container and the solvent container.

The drug container 1 is generally made of a transparent material such as, for example, glass or synthetic resins in the form of a bottle-shaped member reduced in diameter at an open end thereof to form a narrow mouth portion 2. The drug container 1 contains a dose of a dry drug (not shown) such as powdered drugs, freeze-dried drugs or solid preparations and is sealed at the mouth portion 2 thereof by a sealing means 3 including an annular packing 4, a spherical closing member 5, and a holding member 6.

To provide a seat for the packing 4, the drug container 1 is provided with an annular packing seat 21 on an inside wall of the mouth portion 2 close to the open end thereof. The packing seat 21 is generally formed by providing an inwardly extending annular projection on the inside wall of the mouth portion or by making steps on the inside wall of the mouth portion. However, the packing seat 21 may take any of several shapes, provided that it can securely hold the packing 4 in place even when an external force is applied to the packing 4 in a the direction perpendicular to the packing seat 21.

The packing 4 is made of an elastomeric material such as butyl rubber, butadiene rubber, styrene-butadiene rubber, isoprene rubber, urethane rubber or nitrile rubber in the form of an annular member or a disk-like member having a central bore 22 with a diameter smaller than that of the spherical closing member 5.

The spherical closing member 5 has a diameter smaller than the inside diameter of the mouth portion 2 but greater than the inside diameter of the packing 4. The closing member 5 is generally made of glass or a synthetic resin. However, the closing member 5 may be made of any other material, provided that it has a good chemical-resistance and a smooth surface. The spherical closing member 5 is held in place on the packing 4 and forced towards the same by the holding member 6 fitted on the mouth portion 2 of the body of the drug container 1.

Figure 2:
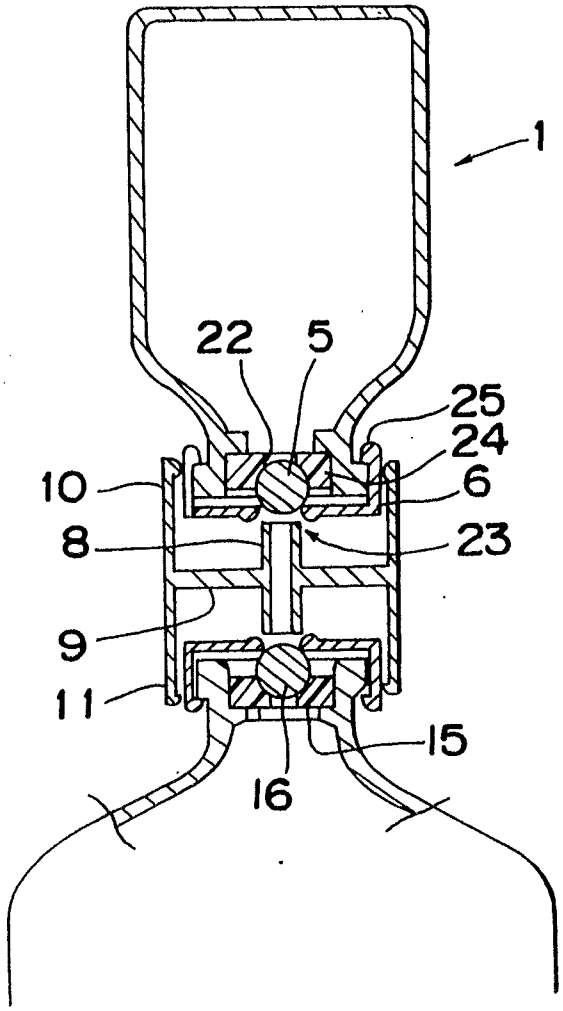

As illustrated in FIG. 2, the holding member 6 is generally made of a flexible resin such as poly-propylene, polyethylene, polycarbonate, polyesters and polyvinyl chlorides in the form of a cap-like member having a bore 23 at a central part of a head portion thereof. This bore 23 has a diameter smaller than the diameter of the spherical closing member 5 but greater than the diameter of bore 22 of the packing 4 to allow a communicating portion 8 of the fluid-communication member 7 to pass drug therethrough once the drug container is communicated to the solvent container 12. At an end of a skirt 24 of the holding member 6 there is provided an inwardly projected rib 25 adapted to be engaged with a flange part of the mouth portion 2 of the drug container 1. The holding member 6 is snapped on the mouth portion 2 of the drug container 1 to snugly hold the spherical closing member 5 in place as well as to press it to the packing 4.

The solvent container 12 is generally made of a flexible resin such as poly-propylene, polyethylene, polycarbonate, polyesters and polyvinyl chlorides in the form of a cylindrical member reduced at both ends in diameter to form first and second mouth portions 13 and 18. The first mouth portion 13 on the top side of the solvent container 12 is adapted to provide a passage for fluid-communication with the drug container 1, while the second mouth portion 18 being adapted to provide a discharge opening for a drug solution prepared by mixing the drug and the solvent.

The first mouth portion 13 of the container 12 is sealed by a sealing member 14. This sealing member includes an annular packing 15 seated on an annular packing seat 26, a spherical closing member 16 and a holding member 17, each having a configuration similar to that of the annular packing 4, spherical closing member 5 and holding member 6. Arrangement of members 15, 16 and 17 are the same as those of the sealing member 3 used in the drug container 1.

The opening of the second mouth portion 18 of the solvent container 12 is generally sealed by a sealing member (for example, a rubber plug) 19 used in well-known solvent containers. The rubber plug 19 is fitted in the second mouth portion 18 of the solvent container 12 and fixed by a capping member 20 secured on the second mouth portion 18 of the solvent container 12. It is to be noted, however, that the second mouth portion 18 may be sealed by a sealing member having a structure similar to that of the sealing member 3 for drug container 1 or that of the sealing member 14 for solvent container 12.

The fluid-communication member 7 is arranged between the drug container 1 and the solvent container 12 to the containers 1 and 12 in fluid communication when the sealing means 3 and 14 are opened. The fluid-communication member 7 include a tubular communicating portion 8 and supporting portion 9 formed as an integral part of the communicating portion 8 at a middle portion thereof. The communicating portion 8 is adapted to be fitted in the bore of the packing when connecting the drug container 1 with the solvent container 12. In general, the fluid-communication member is made of a chemical-resistant synthetic resin such as polypropylene and acrylonitrile-butadiene-styrene (ABS) copolymers.

The fluid-communication member 7 may include a guiding member which extends coaxially with the communicating portion 8 from the supporting portion 9 to assist in the sliding movement of the containers 1 and 12. In the embodiment illustrated in FIG. 1, the guiding member is defined by a cylindrical portion which is formed as an integral part of the supporting portion 9 and partitioned by the supporting portion 9 into two parts, i.e., an upwardly extending, upper guiding portion 10 for the mouth portion of the drug container 1, and a downwardly extending, lower guiding portion 11 for the mouth portion of the solvent container 12. The upper guiding portion 10 is fitted on the holding member 6 of the sealing member 3 for the drug container 1, while the lower guiding portion 11 is fitted on the holding member 17 of the sealing member 14 for the solvent container 12.

The fluid-communication member 7 may be used in combination with a drug container of which a mouth portion is closed by a rubber plug. In this case, the fluid-communication member 7 is designed so as to have an edged communicating portion 8 at one end thereof.

Further, the lower guiding portion 11 of the guiding means may be provided at its lower end with an inwardly projected annular rib as occasion demands. In this case, the annular rib is engaged with a flange of the mouth portion of the solvent container, as well as an annular rib 32 of a capsule 30 shown in FIG. 4.

Figure 4:
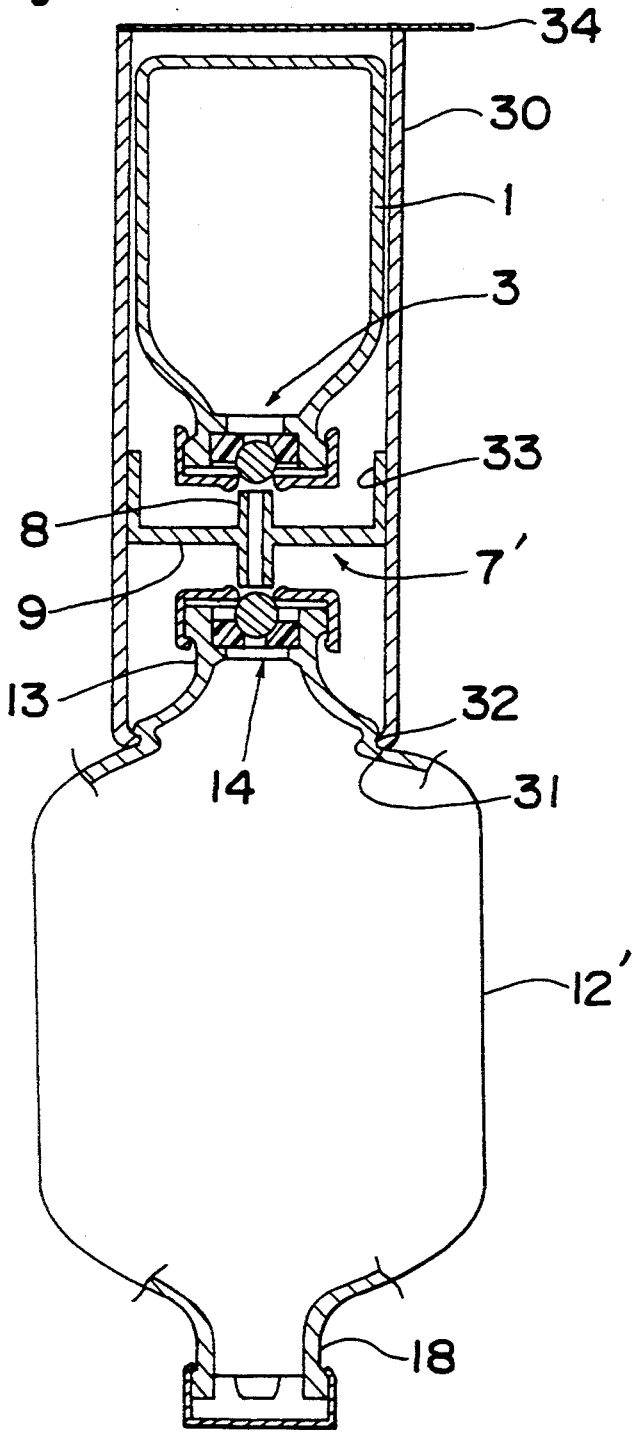
FIG. 4 is a partial sectional view of a drug delivery system illustrating another preferred embodiment of the present invention.

All the parts of the drug delivery system according to the present invention may be packed separately or in combination, for example, into two packages, one for a drug container 1 with a fluid-communication member 7, and the other for a solvent container 12. Also, as illustrated in FIG. 1 and FIG. 4, these parts may be assembled as one body and then packed into one package to make the system easy to operate. In such a case, it is preferred to aseptically seal a gap formed between the holding member 6 of the sealing member 3 and the guiding member 10 of the fluid-communication member 7 and a gap between the holding member 17 of the sealing member 14 and the guiding member 11 of the fluid-communication member 7 with a suitable sealing means such as an O-ring (not illustrated) to protect the mouth portion 2, opening 13 and the communicating portion 8 from bacteria. Also, provision of a hanging member (not illustrated) on the mouth portion 2 or the neck portion on the side of the opening 13 of the solvent container facilitates intravenous drip infusion.

Referring now to FIG. 4, there is shown another form of a drug delivery system according to the present invention, which includes a drug container 1 having a mouth portion 2 at one end thereof, a solvent container 12' having first and second openings 13 and 18 and a fluid-communication member 7' arranged between two containers 1 and 12. The system further includes a guiding capsule 30 which serves as a guiding member and enveloping member.

The drug container 1 has essentially the same structure as that of the drug delivery system of FIG. 1, while the fluid-communication member 7' and solvent container 12' differ from those of the drug delivery system of FIG. 1. The fluid-communication member 7' is provided with a cylindrical portion 33 extending from a supporting portion 9 in direction facing the drug container 1. The capsule 30 is fixed at one end to the neck portion of the solvent container 12' by engagement with a (or annula rib) groove 32 provided around the neck portion of the solvent container 12'. The fluid-communication member 7' and the drug container 1 are slidably arranged in the capsule 30 and the capsule 30 is sealed at its other end by a sealing member 34.

Figure 5:
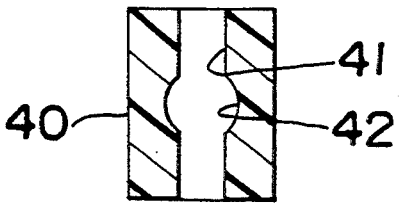
FIG. 5 is a sectional view illustrating another form of a sealing member used in another preferred embodiment of the present invention.

In the foregoing embodiments, the annular packing 4 and 15 are used as a part of the sealing member 3 and 14, but these packing mechanisms may be replaced with a cylindrical packing 40 having a configuration as shown in FIG. 5. The cylindrical packing 40 has a hollow core 41 passing therethrough and having a spherical hollow portion 42 with a diameter smaller than that of the spherical closing member 5. In this case, the closing member 5 is press-fitted in the spherical hollow portion 42 to close the core 41, and the packing 40 is forced to the packing seat 21 by the holding member 6. Further, the spherical closing member 5 may be a hollow spherical member 42.

Figure 3:
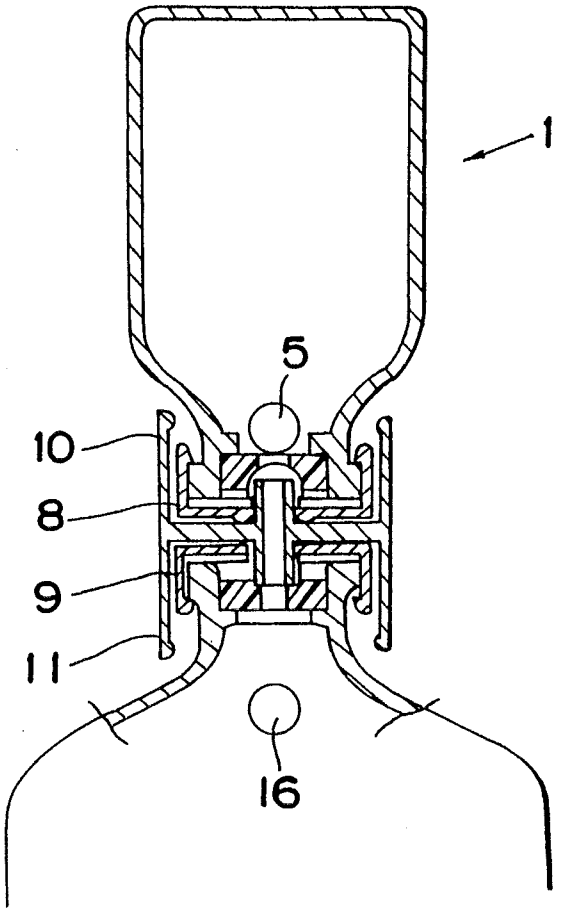
FIGS. 2 and 3 are enlarged sectional views illustrating a communicating sticking operation of the drug delivery system of FIG. 1.

In use, the drug delivery system, for example, of FIG. 1 is operated in the following manner. Firstly, the drug container 1 is manually forced into engagement with the fluid-communication member 7. To this end, the communicating portion 8 is brought into contact with the spherical closing members 5 and 16 of the sealing member 3 and 14. By further increasing the external force applied to the drug container 1, the closing members 5 and 16 are forced into the packing 4 and 15 to pass therethrough and pushed into the respective containers 1 and 12 as shown in FIG. 3. Thus, the drug container 1 is communicated with the solvent container 12.

The drug delivery system is then inverted to allow the solvent in the solvent container 12 to flow into the drug container 1 through the bores of communicating portion 8 of the fluid-communication member 7, shaken to prepare a homogeneous solution, and then turned upside down again to allow the resultant drug solution in the drug container 1 to flow into the solvent container 12. The resultant solution may be used for intravenous drip infusion by using a needle of a solution infusion set to pierce the rubber plug 19 of the solvent container 12.

Thus, the drug delivery system according to the present invention makes it possible to avoid coring of the rubber plug so that no piercing needle is needed to connect the drug container with the solvent container, which in turn makes it possible to prevent containmater of the drug solution with small rubber pieces. Also, the drug delivery system is easy to operate and enables to save time, thus making it possible to lighten the burden its operator. Since the drug container is connected to the solvent container by the tubular portion of the fluid-communication member as adapted to be force fitted in the bores of the packing, there is no fear of leakage of the drug solution from the drug delivery system. In addition, it is possible to aseptically perform mixing operations of the drug and the solvent.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A two component mixing and delivering system, comprising:

a first container having a mouth portion with a flanged outer rim;

a second container having first and second openings, wherein said first opening includes a flanged outer rim;

means for sealing the mouth of the first container including, a first annular packing disposed within the mouth portion of the first container, said first annular packing having a traverse bore, a first spherical closing member seated within the bore of the first annular packing, a first means for holding the first spherical closing member within the bore of the first annular packing for sealing the first container, said first holding means including an annular skirt for securing the first holding means to the first container by engaging the flanged outer rim of the first container; and means for sealing the first opening of the second container including, a second annular packing disposed within the first opening of the second container, said annular packing having a traverse bore, a second spherical closing member seated within the bore of the second annular packing, a second means for holding the second spherical closing member within the bore of the second annular packing for sealing the second container, said second holding means including an annular skirt for securing the second holding means to the second container by engaging the flanged outer rim of the second container; and a fluid-communication member for communicating between said first container and said second container, said fluid-communication member being arranged between said mouth portion of the first container and said first opening of the second container and including a tubular member with a longitudinal bore therethrough aligned with a central bore in each of said first and second holding means for communicating the contents of the first container with the second container by removing each of the first and second spherical closing members.

2. The two component mixing and delivering system according to claim 1, wherein said fluid-communication member includes a guiding means for directing the tubular member into operative engagement with the central bore of each of said first and second holding means with a first guiding portion for guiding the tubular member into alignment with the mouth portion of the first container and a second guiding portion for guiding the tubular member into alignment with the first opening of the second container.

3. The two component mixing and delivering system according to claim 1, wherein each of said first and second holding means are cap shaped.

4. The two component mixing and delivery system according to claim 1 further including a guiding capsule for holding the first container, the fluid-communication member and the first opening of the second container therein, said capsule being fixed at its one end to the second container and sealed at the other end, said first container and fluid-communication member being slidably arranged in said capsule.

5. The two component mixing and delivering system according to claim 1 wherein said first and second annular skirts each have an inwardly projecting rib for engaging the flanged outer rim of the first and second containers.

* * * * *